US006676234B2

(12) United States Patent
Herbeck et al.

(10) Patent No.: US 6,676,234 B2
(45) Date of Patent: Jan. 13, 2004

(54) THERMAL BARRIER FOR AIR HANDLER (AHU) CABINET

(75) Inventors: Christian C. Herbeck, Manchester, TN (US); Michael W. Austin, McMinnville, TN (US)

(73) Assignee: Carrier Corporation, Farmington, CT (US)

( * ) Notice: Subject to any disclaimer, the term of this patent is extended or adjusted under 35 U.S.C. 154(b) by 263 days.

(21) Appl. No.: 09/904,684

(22) Filed: Jul. 13, 2001

(65) Prior Publication Data

US 2003/0009969 A1 Jan. 16, 2003

(51) Int. Cl.[7] ..... A47B 77/08
(52) U.S. Cl. ..... 312/265.4; 312/236
(58) Field of Search ..... 312/265.1, 265.2, 312/265.3, 265.4, 265.5, 265.6, 236, 257.1, 263; 52/794.1, 801.11, 579, 309.4, 309.9, 581

(56) References Cited

U.S. PATENT DOCUMENTS

| | | | | |
|---|---|---|---|---|
| 2,139,618 A | * | 12/1938 | Hall | 220/4.02 |
| 2,180,177 A | | 11/1939 | Ternstrom | |
| 2,240,487 A | * | 5/1941 | Benham | 52/792.1 |
| 3,915,328 A | * | 10/1975 | Hawes et al. | 220/592.06 |
| 4,034,511 A | * | 7/1977 | Bursk | 49/489.1 |
| 4,574,537 A | * | 3/1986 | Krieger | 52/127.9 |
| 4,656,795 A | | 4/1987 | Albrecht et al. | |
| 4,732,012 A | * | 3/1988 | Thorpe | 62/304 |
| 5,870,868 A | | 2/1999 | Kita et al. | |
| 6,205,738 B1 | * | 3/2001 | Chen | 52/653.2 |
| 6,350,000 B1 | * | 2/2002 | Van Benthem et al. | 312/236 |
| 6,497,256 B1 | * | 12/2002 | Adams et al. | 138/149 |
| 6,530,191 B2 | * | 3/2003 | Rieke et al. | 52/794.1 |
| 6,530,630 B2 | * | 3/2003 | Austin et al. | 312/265.4 |

FOREIGN PATENT DOCUMENTS

| | | |
|---|---|---|
| DE | 1917949 | 10/1970 |
| DE | 4422971 A1 | 1/1994 |
| EP | 0038015 A2 | 10/1981 |
| GB | 1127308 | 9/1968 |
| NL | 1014208 | 7/2001 |
| WO | 01/50068 A1 | 7/2001 |

* cited by examiner

*Primary Examiner*—Janet M. Wilkens
(74) *Attorney, Agent, or Firm*—Wall Marjama & Bilinski LLP

(57) ABSTRACT

A panel for use in an air handling unit that conducts air along an enclosed path of travel. The panel includes a rectangular shaped frame made of a plastic material having a low thermal conductivity. The frame is closed by top and bottom cover plates having skirts that are contained in top and bottom channels that encircle the inside of the frame and thus establish an enclosed cavity within the panel. A curable polyurethane foam is injected into the cavity to fill the cavity. The foam sets to bond the covers to the frame and to provide a thermal barrier that impedes the flow of heat through the panel.

6 Claims, 6 Drawing Sheets

THERMAL BARRIER FOR AIR HANDLER (AHU) CABINET

FIELD OF THE INVENTION

This invention relates generally to a panel for use in an air handling unit that forms a thermal barrier to limit the flow of energy into and out of the unit.

BACKGROUND OF THE INVENTION

Many air handling units found in the prior art are simply fabricated from sheet metal ducts that are brought together in the field to establish an enclosed flow path through which air is moved. The sheet metal walls of the ducts readily conduct heat and provide little in the way of a thermal barrier. As a consequence, heat is able to flow freely into or out of the duct work. When the air handling unit is moving conditioned air, this flow of energy into or out of the duct work can be costly and places an unwanted load on the air conditioning equipment.

In addition, when the air handling unit is installed in an unconditioned space and is carrying cooled air, the outer casing of the unit will "sweat". The moisture so developed can run off of the unit onto the floor or equipment located within close proximity with the unit. Water on a walkway can produce slippery conditions and lead to accidents. Moisture falling upon machinery can produce corrosion damage and electrical failures.

SUMMARY OF THE INVENTION

It is an object of the present invention to improve air handling units for conducting air along a desired flow path.

A further object of the present invention is to limit the loss of energy through the walls of a duct carrying conditioned air.

A still further object of the present invention is to provide an improved panel for closing openings in the framework of an air handling unit.

Another object of the present invention is to provide a structural panel for use in an air handling unit that has a low thermal conductivity.

Yet another object of the present invention is to prevent the duct work of an air handling unit from sweating when carrying conditioned air.

These and other objects of the present invention are attained by a panel suitable for use in an air handling unit for conducting air along an enclosed path of travel. The panel includes a rectangular frame made of a material having a low thermal conductivity. The frame is closed by a top cover and a bottom cover so that a cavity is established within the panel. The cavity is filled with a curable foam material that sets inside the panel to bond together the walls of the frame and the covers to the frame. The foam has a low thermal conductivity so that the panel acts as a thermal barrier to impede the flow of heat into and out of the unit.

BRIEF DESCRIPTION OF THE DRAWING

For a better understanding of these and other objects of the invention, reference will be made to the following detailed description of the invention which is to be read in association with the accompanying drawings, wherein.

DETAILED DESCRIPTION OF THE INVENTION

Figure 1:
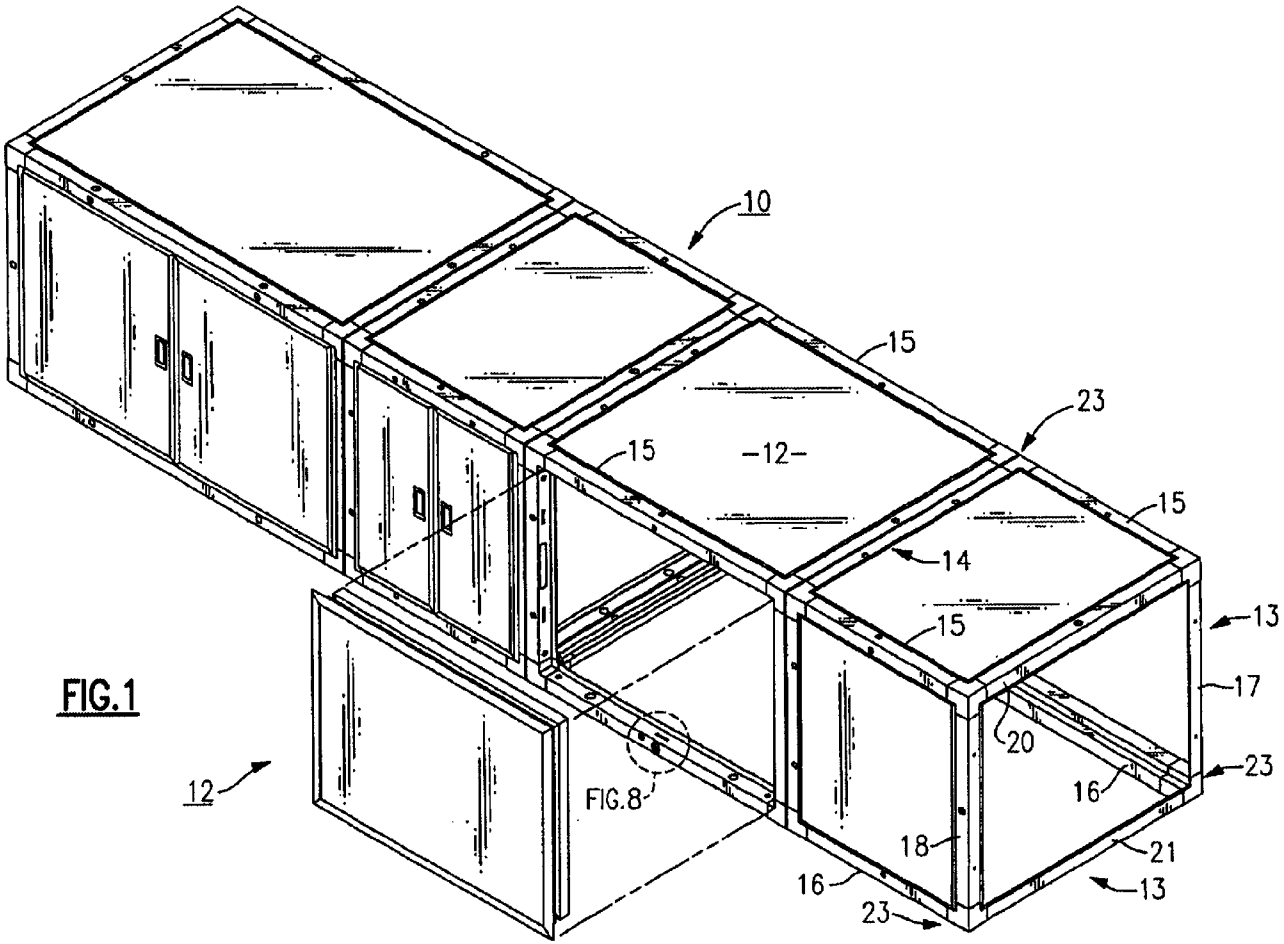
FIG. 1 is a perspective view showing a portion of an air handling unit containing panels embodying the teaching of the present invention.
Figure 2:
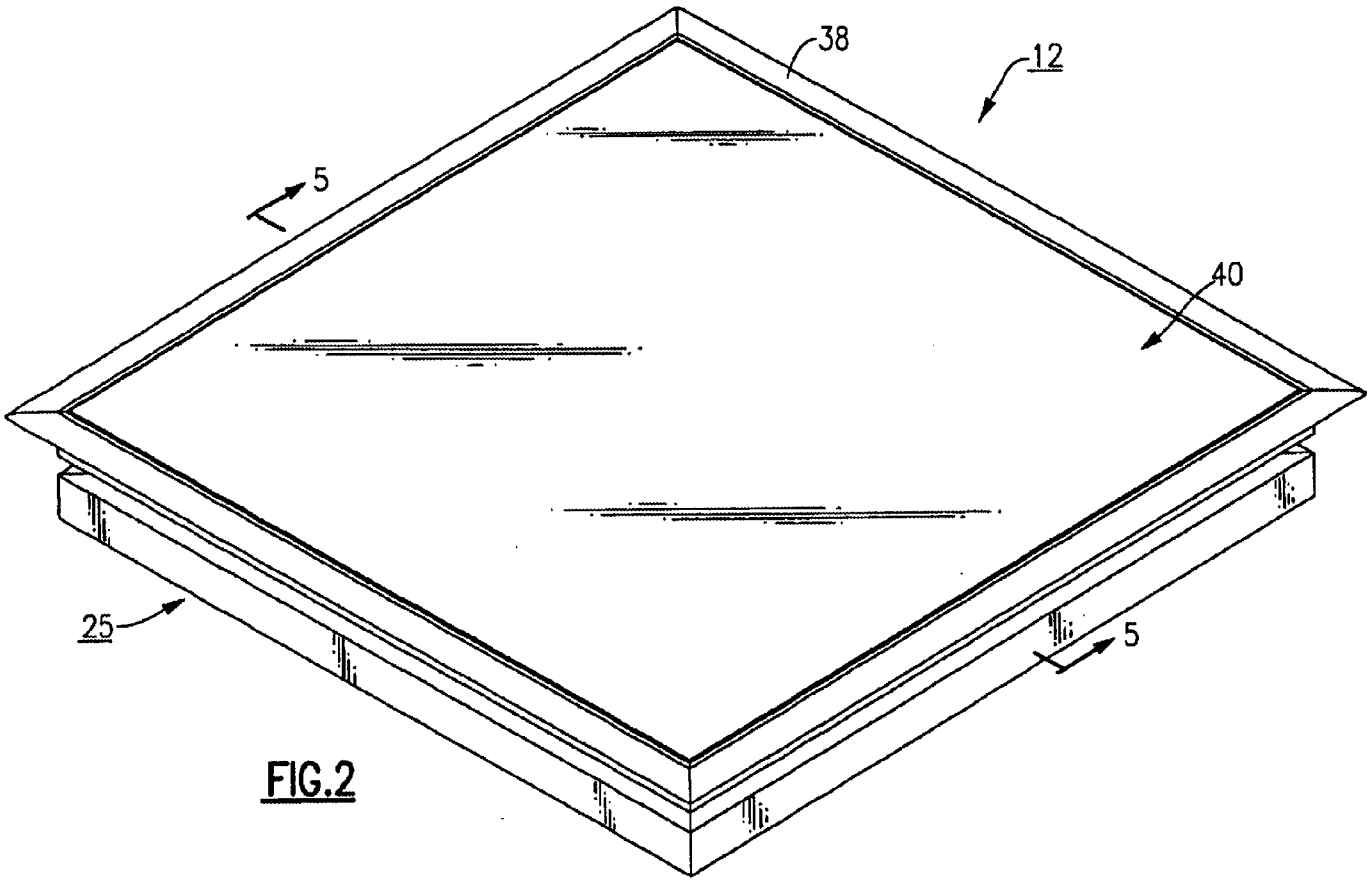
FIG. 2 is an enlarged perspective view of a panel employed to enclose an opening in the framework of the air handling unit.
Figure 3:
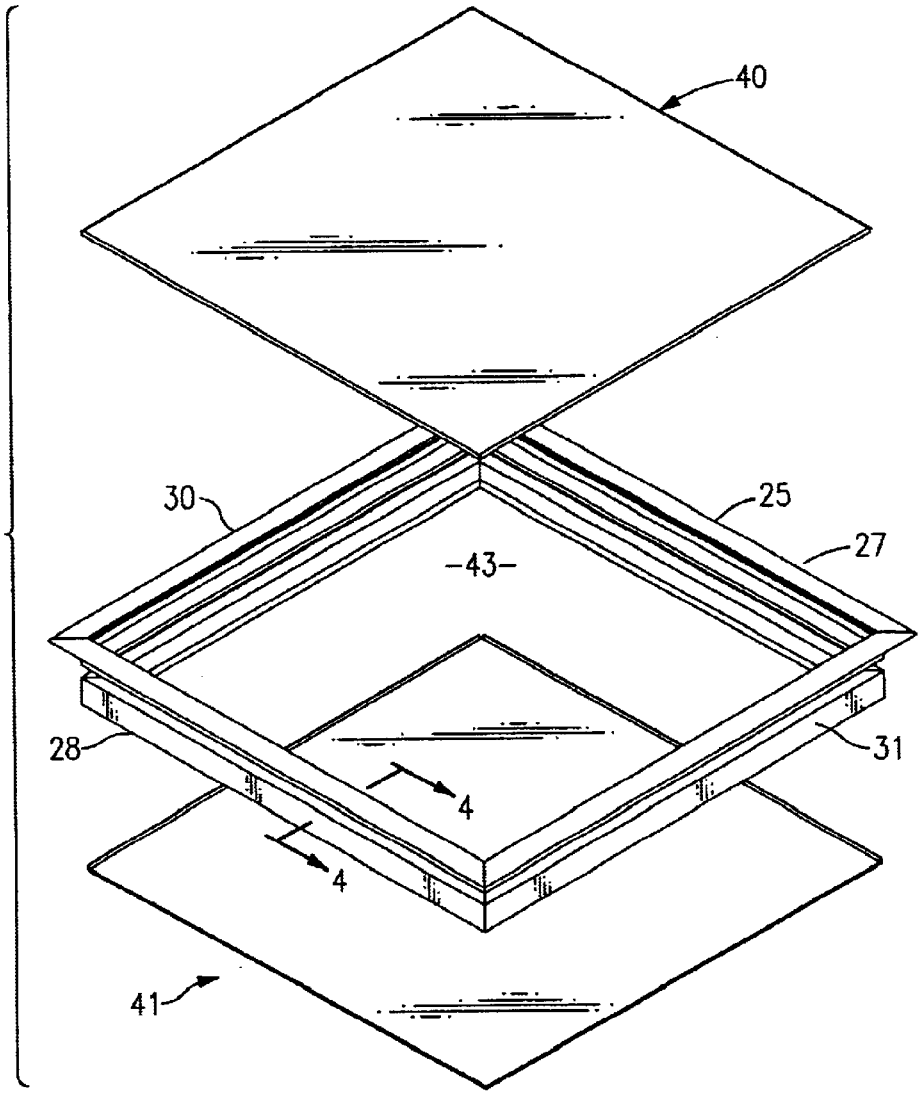
FIG. 3 is an exploded view illustrating the panel frame and covers.

Turning initially to FIG. 1 there is illustrated a portion of an air handling unit (AHU), generally referenced 10, that employs wall panels 12 embodying the teachings of the present invention. The air handling unit is made up of a series of rectangular shaped modular sections each of which contains its own superstructure made up of a pair of end frames 13 and 14 that are connected at the comers by horizontally disposed upper beams 15 and lower beams 16. Each end frame includes two opposed side rails 17 and 18 and an upper rail 20 and a lower rail 21. In assembly, the rails and the beams are slidably retained in comer pieces 23. The rails and beams will herein be jointly referred to as structural elements. The structural elements, in assembly, thus establish a framework having rectangular openings.

As will be explained in greater detail below, wall panels embodying the teachings of the present invention are locked in place within the openings in the framework to close each of the modular sections. Each panel is constructed so that it has a low thermal conductivity and thus acts as a thermal barrier to greatly impede the flow of heat into or out of the unit. By establishing this type of thermal barrier, the generation of condensate along the outer walls of the unit is considerably reduced or eliminated.

Figure 4:
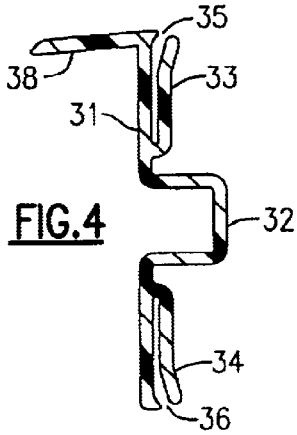
FIG. 4 is an enlarged sectional view of the panel frame taken along line 4—4 in FIG. 3.

With further reference to FIGS. 2–5, each panel 12 includes a rectangular frame 25 having a pair of opposed side walls 27 and 28 and a pair of opposed end walls 29 and 30. Each wall contains mitered ends so that the walls can be brought together to form right angle comers. Each wall is molded of a plastic material having a low thermal conductivity. As best illustrated in FIG. 4, each wall contains a vertically disposed wall partition 31 having a rectangular shaped recess 32 formed centrally therein that extends along the length of the partition. The recess is inwardly disposed with reference to the outer surface of the partition. An upper tab 33 and a lower tab 34 are integrally molded on the inside of the partition on either side of the recess. The tabs, like the recess, extend along the length of each wall and thus encircle the panel. The tabs run parallel to the partition and coact therewith to form upper and lower channels 35 and 36. The upper channel 35 opens towards the top of each wall while the lower channel opens toward the bottom of each wall. A horizontally disposed flange 38, which is integral with the wall partition, runs along the top edge of each partition. The flanges extend outwardly from the wall partitions and form an angle with each wall that is slightly less than 90° so that the flange extends downwardly at a slight angle from the top edge of the partition.

Figure 5:
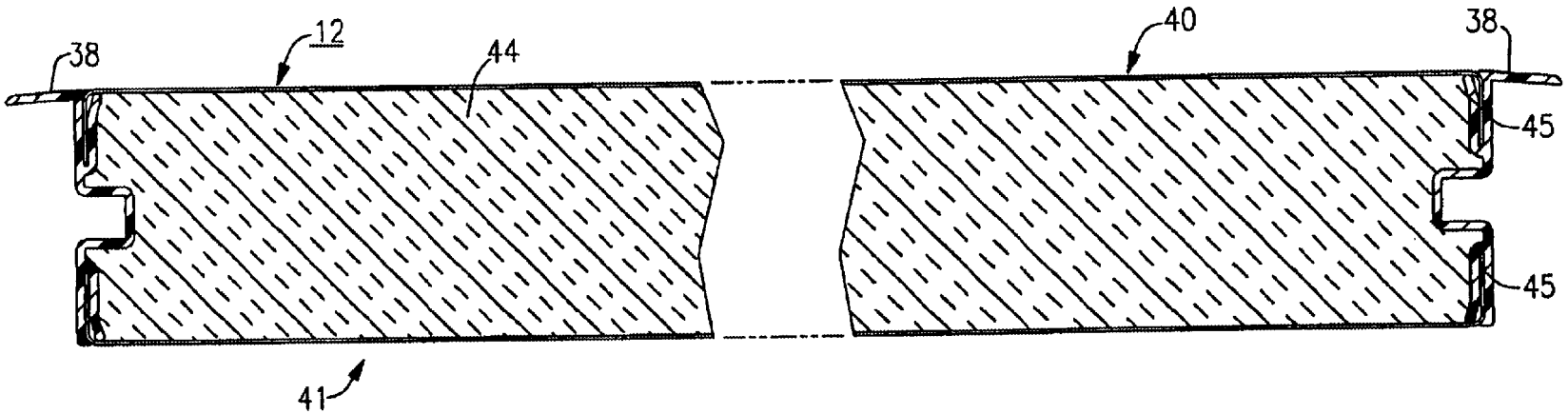
FIG. 5 is an enlarged sectional view of the panel assembly taken along lines 5—5 in FIG. 2.

As illustrated in FIG. 5, a top cover 40 and a bottom cover 41 are used to close the frame and create a cavity 43 inside the panel. Each cover contains an inwardly directed skirt 45 that depends downwardly from the cover and extends around the entire periphery of the cover. In assembly, the skirts are inserted into the upper and lower channels that encircle the panel frame. A curable foam is injected into the cavity to entirely fill the cavity. When the foam sets, it bonds the frame walls together in abutting contact as well as bonding the covers to the frame. Preferably, the curable foam is a polyurethane material which, like the panel frame walls, has a very low thermal conductivity.

Each panel is sized so that the panel frame can be slipped into an opening in one of the unit sections. A close sliding fit is provided between panel frame walls and the surrounding structural element that form the receiving opening. When the panel is fully received within the opening, the flange 38 that surrounds the panel frame is compressed against the outer surfaces of the structural elements forming the opening, thus providing a positive seal around the periphery of the opening.

Figure 6:
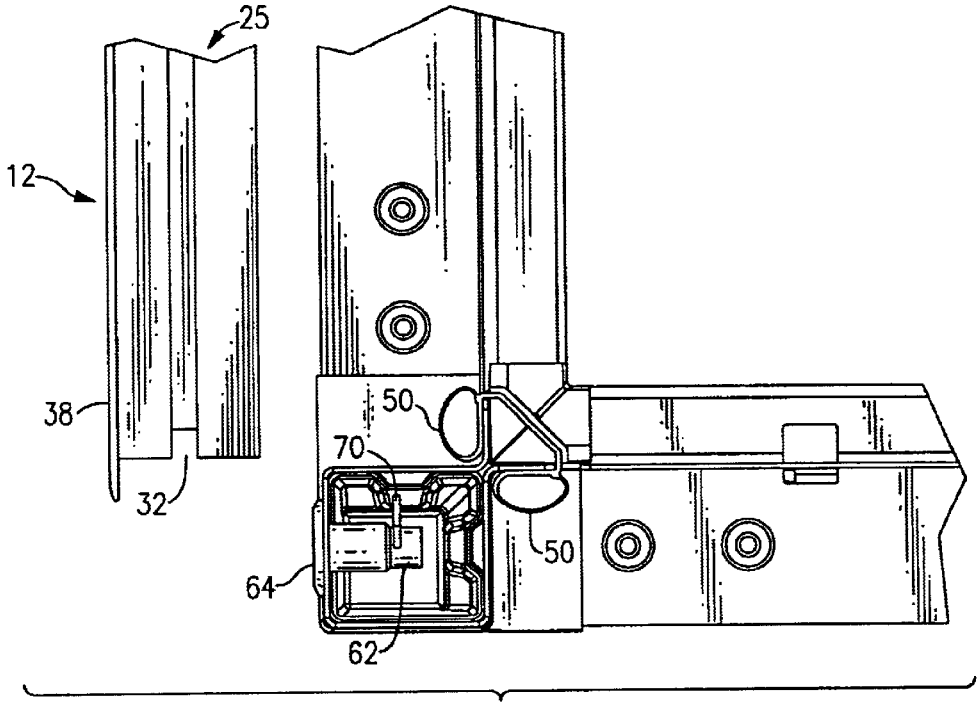
FIG. 6 is an enlarged partial view showing a comer section of the framework of the air handling unit with one of the panels being removed from the framework.
Figure 7:
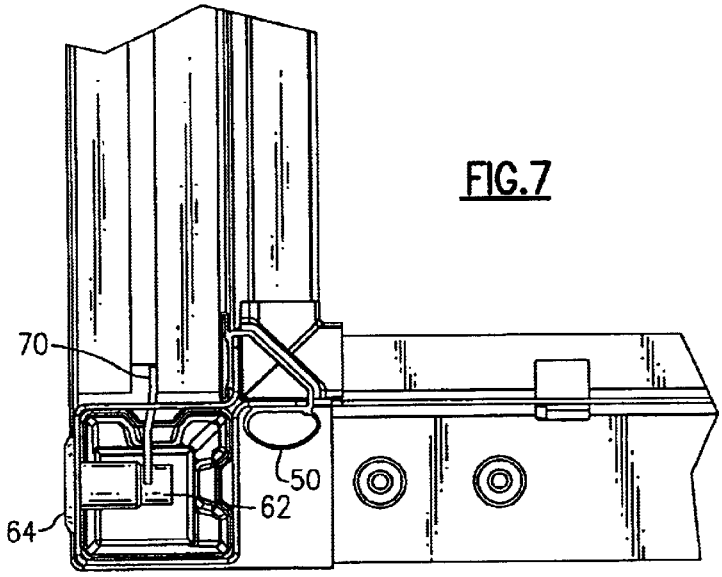
FIG. 7 is a view similar to FIG. 6 showing the panel locked in a closed position within the framework.

As illustrated in FIGS. 6 and 7, compressible hollow bulb seals 50 are also mounted around the inside periphery of the panel receiving opening. At panel closure, bulb seals are compressed by the cover as shown in FIG. 7 to prevent air that is being conducted through the unit from escaping around the panel.

Figure 8:
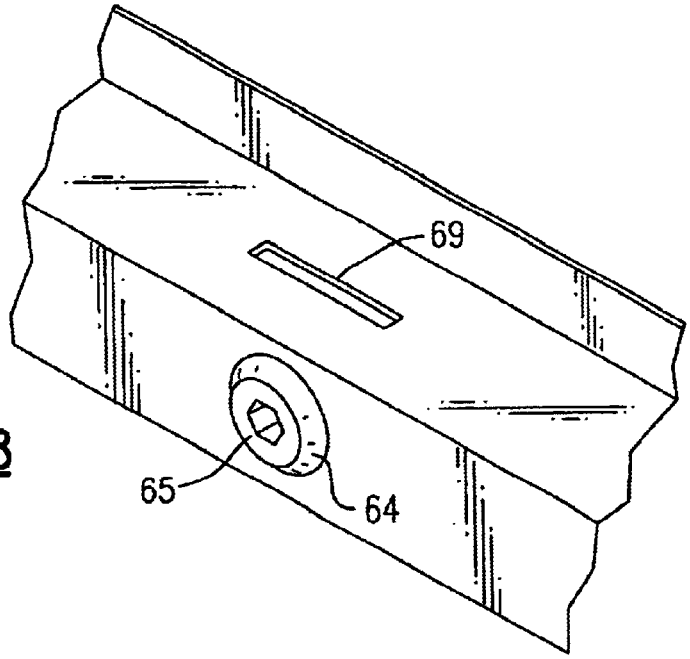
FIG. 8 is an enlarged perspective view showing the latching mechanism for locking a panel to the framework in a retracted position.
Figure 9:
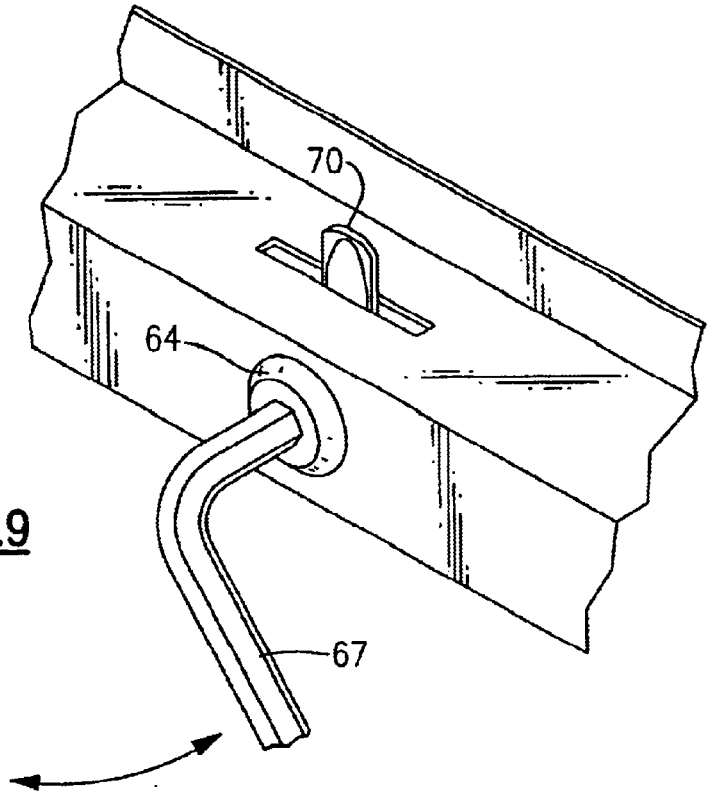
FIG. 9 is a view that is similar to FIG. 8 showing the latching mechanism in a raised locking position.

The panels are held in a closed position by a series of latching mechanisms, generally referenced 60, that are mounted inside the structural elements surrounding each opening. Preferably, the structural elements are square metal tubes that are slidably retained in the corner pieces. Each latching mechanism includes a cylindrical rotor 62 that is rotatably contained within a stationary tube 63. The rotor extends beyond the distal end of the tube and an elongated arm 70 is secured to the extended end of the rotor. A six sided slot 65 passes inwardly through the proximal end of the rotor. An Allen wrench 67 can be insertable into the slot and used to turn the rotor between a first open position and a second locking position. The elongated arm is arranged to pass upwardly through a slotted hole 69 in the containing tube as the tumbler is turned from the first open position as illustrated in FIG. 8 to the second locking position as illustrated in FIG. 9. As illustrated in FIG. 7, the arm is arranged to pass into the recess 32 surrounding the panel frame and force the panel into sealing contact against the seals 50 that surround the panel receiving opening. Preferably, at least one latching mechanism is employed to engage each wall of the panel frame to insure a complete seal around the entire periphery of the panel.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. In an air handling unit containing a framework having rectangular openings therein that is formed of structural elements, a panel for closing the openings in said framework that includes a rectangular frame having opposed side walls and opposed end walls, each wall containing an upper channel opening to the top of said wall and a lower channel opening to the bottom of said wall, an upper cover and a lower cover each having a skirt that extends around the periphery of said cover, wherein the skirt of the upper cover is contained in the upper channel of said frame and the skirt of the lower cover is contained in the lower channel of said frame to establish a cavity within said panel, a curable foam material filling said cavity which sets to bond the frame walls and the covers together in assembly; and wherein said frame contains an inwardly directed recess that encircles said frame and wherein a plurality of locking arms contained within said structural elements are receivable within said recess for securing the panel in said opening.

2. The panel of claim 1 wherein the covers are fabricated of metal and the walls of the frame are fabricated of plastic having a thermal conductivity that is lower than that of the covers.

3. The panel of claim 2 wherein said foam is a polyurethane having a thermal conductivity that is lower than that of the covers so that the panel forms a thermal barrier to impede the flow of heat through said panel.

4. The panel of claim 1, wherein an outwardly extended flange surrounds the upper edge of said frame.

5. The panel of claim 4 wherein the flange is integral with said frame and forms an angle less than 90° with the walls of said frame.

6. The panel of claim 1 wherein said recess is rectangular shaped.

* * * * *